US011267007B2

(12) United States Patent
Kang et al.

(10) Patent No.: US 11,267,007 B2
(45) Date of Patent: Mar. 8, 2022

(54) COSMETIC VESSEL

(71) Applicant: LG HOUSEHOLD & HEALTH CARE LTD., Seoul (KR)

(72) Inventors: Jae Shin Kang, Seoul (KR); Ki Hyun Kim, Seoul (KR); Hye Jin Lee, Seoul (KR); Ha Young Kim, Seoul (KR)

(73) Assignee: LG HOUSEHOLD & HEALTH CARE LTD., Seoul (KR)

( * ) Notice: Subject to any disclaimer, the term of this patent is extended or adjusted under 35 U.S.C. 154(b) by 0 days.

(21) Appl. No.: 17/207,993

(22) Filed: Mar. 22, 2021

(65) Prior Publication Data

US 2021/0370329 A1 Dec. 2, 2021

(30) Foreign Application Priority Data

Jun. 2, 2020 (KR) ..... 10-2020-0066740

(51) Int. Cl.
*B05B 11/00* (2006.01)
*A45D 34/00* (2006.01)

(52) U.S. Cl.
CPC ..... *B05B 11/0044* (2018.08); *A45D 34/00* (2013.01); *B05B 11/3052* (2013.01); *A45D 2200/056* (2013.01)

(58) Field of Classification Search
CPC ..... B05B 11/0044; B05B 11/3054; B05B 11/0038; A45D 34/00; A45D 2200/056; A45D 34/04; A45D 40/26; A61K 8/0208; B65D 77/04
See application file for complete search history.

(56) References Cited

U.S. PATENT DOCUMENTS

| | | | |
|---|---|---|---|
| 2016/0242530 | A1 | 8/2016 | Son et al. |
| 2017/0305642 | A1 | 10/2017 | Kang |
| 2018/0295967 | A1 | 10/2018 | Byeon |

FOREIGN PATENT DOCUMENTS

| | | | |
|---|---|---|---|
| JP | 3954297 | B2 | 8/2007 |
| KR | 20-0470757 | Y1 | 1/2014 |
| KR | 10-1517595 | B1 | 5/2015 |
| KR | 10-1559078 | B1 | 10/2015 |
| KR | 20-2016-0000891 | U | 3/2016 |
| KR | 20-2017-0002211 | U | 6/2017 |
| KR | 20-0486987 | Y1 | 7/2018 |
| KR | 10-1903037 | B1 | 10/2018 |
| KR | 10-2153903 | B1 | 9/2020 |

*Primary Examiner* — Vishal Pancholi
(74) *Attorney, Agent, or Firm* — Birch, Stewart, Kolasch & Birch, LLP

(57) ABSTRACT

A cosmetic vessel may include a vessel body including an inner case configured to accommodate cosmetics and having an inlet, and an outer case configured to accommodate the inner case therein and having an opening in a top thereof, a cap part coupled to the open top of the outer case, a discharge means coupled to the inlet and configured to discharge the cosmetics to an outside through a suction pipe extending to a bottom surface of the inner case, and a discharge part moving downwards to operate the discharge means and configured to transmit the cosmetics discharged from the discharge means to the outside.

8 Claims, 11 Drawing Sheets

COSMETIC VESSEL

CROSS-REFERENCE TO RELATED APPLICATION

The present application claims priority under 35 U.S.C. § 119(a) to Korean patent application number 10-2020-0066740, filed on Jun. 2, 2020, in the Korean Intellectual Property Office, the entire disclosure of which is incorporated herein by reference.

BACKGROUND

1. Technical Field

The present disclosure relates to a cosmetic vessel.

2. Related Art

Generally, solid cosmetics such as foundations and liquid cosmetics such as sun blocks, which are widely used, are used to realize the effects of protecting and brightening the skin and reducing wrinkles. A user may use a method of absorbing cosmetics in a puff and then applying the cosmetics to the skin.

The puff may be sold while being stored in a cosmetic vessel. The puff may be usually accommodated in a cap of the cosmetic vessel. Therefore, in order to use the cosmetics, a user opens the cap to take the puff out from the cosmetic vessel. Then, the user makes the puff come into contact with the cosmetics with the user's finger being fitted into an elastic strap or the like provided on the puff to apply a predetermined amount of cosmetics to the puff.

Since the user should directly make the puff come into contact with the cosmetics, an excessive amount of cosmetics may be applied to the puff depending on the pressure of the user pressing the cosmetics using the puff, thus undesirably causing the waste of the puff. Therefore, recently, there has been developed a method in which sponge is impregnated with the cosmetics and the user presses the sponge with the puff, thus supplying liquid cosmetics penetrated into the sponge to the puff.

However, such a conventional cosmetic vessel is problematic in that an excessive amount of cosmetics may be applied to the puff depending on the pressure of the user pressing the sponge, as in the related art. Further, this is problematic in that, when the user presses the sponge with excessive pressure by mistake, the cosmetics are applied to a surface of the puff coming into direct contact with the skin as well as a surface adjacent to the user's finger, thus causing great inconvenience to the user.

Therefore, there is a need for cosmetic vessels that can discharge a fixed amount of liquid cosmetics, and widely and evenly discharge the cosmetics to be uniformly penetrated into the sponge, thus allowing a user to efficiently spread apply the cosmetics.

SUMMARY

The present disclosure has been made to solve the above-mentioned problems and difficulties and relates to a cosmetic vessel, which can widely and evenly discharge liquid cosmetics.

A cosmetic vessel according to an embodiment of the present disclosure includes a vessel body including an inner case configured to accommodate cosmetics and having an inlet, and an outer case configured to accommodate the inner case therein and having an opening in a top thereof; a cap part coupled to the open top of the outer case; a discharge means coupled to the inlet, and configured to discharge the cosmetics to an outside through a suction pipe extending to a bottom surface of the inner case; and a discharge part moving downwards to operate the discharge means, and configured to transmit the cosmetics discharged from the discharge means to the outside, wherein the discharge part may include a discharge plate provided on a side of the discharge means through which the cosmetics are discharged and having a discharge hole, a guide part configured to transmit the cosmetics discharged from the discharge means to the discharge hole, and a guide ring coupled to a circumference of the guide part, wherein the cap part may be provided to enclose the guide ring and to open or close the discharge part, and be configured such that outside air passes between the guide ring and the cap part to be transmitted to the inner case when the cosmetics are discharged by an operation of the discharge means, and wherein the outer case may have a cross-sectional shape different from that of the inner case, and include a restraining part which engages with the inner case to restrain a position of the inner case.

The inner case may have a circular cross-section, and the outer case may have a non-circular cross-section.

A fixing hole may be provided at a predetermined point on a circumference of the inner case, and the restraining part may include a fixing end which extends from an inside of the outer case towards the fixing hole, and engages with the fixing hole when the inner case is accommodated in the outer case, thus restricting rotation of the inner case in the outer case.

The outer case may include a bottom cover which is detachably attached to a bottom thereof and on which the inner case is seated, and the bottom cover may have a projection engaging with the circumference of the inner case.

The discharge part may further include an impregnation member provided on an upper surface of the discharge plate, and the guide ring may fix the guide part and the impregnation member.

The guide part may be configured such that the circumference thereof protrudes upwards, and the guide ring may include a step which is bent inwards at an upper end thereof and engages with a circumference of the impregnation member, and a protrusion which protrudes from an inner circumference thereof to be caught by a lower end of the guide part.

The guide part may be configured such that the circumference thereof protrudes upwards, a height of a circumferential part of the discharge plate may correspond to that of the upwardly protruding circumference of the guide part, and the guide ring may include a step which is bent inwards at an upper end thereof and engages with a circumference of the discharge plate, and a protrusion which protrudes from an inner circumference thereof to be caught by a lower end of the guide part.

The discharge plate may engage with the guide part through an uneven structure around an outside of the discharge hole.

DETAILED DESCRIPTION

Figure 1:
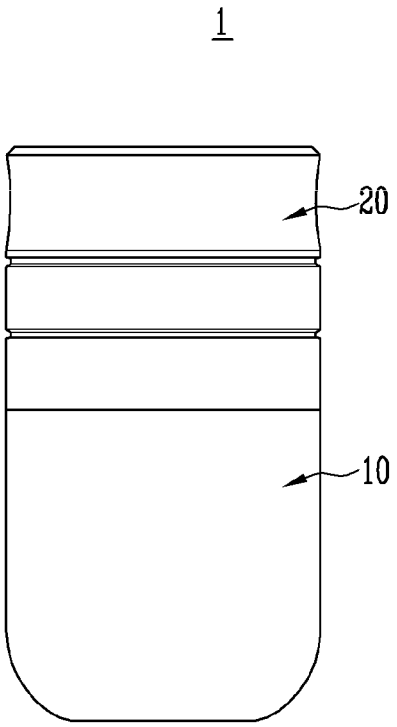
FIGS. 1 and 2 are front views illustrating a cosmetic vessel in accordance with a first embodiment of the present disclosure.

The above and other objects, advantages, and features of the present disclosure will be more clearly understood from the following detailed description when taken in conjunction with the accompanying drawings. In the present specification, it should be noted that the same reference numerals are used to denote the same components throughout different drawings. In the following description, the detailed description of the related art that may unnecessarily obscure the subject matter of the present disclosure will be omitted.

Hereinafter, preferred embodiments of the present disclosure will be described in detail with reference to the accompanying drawings.

Figure 2:
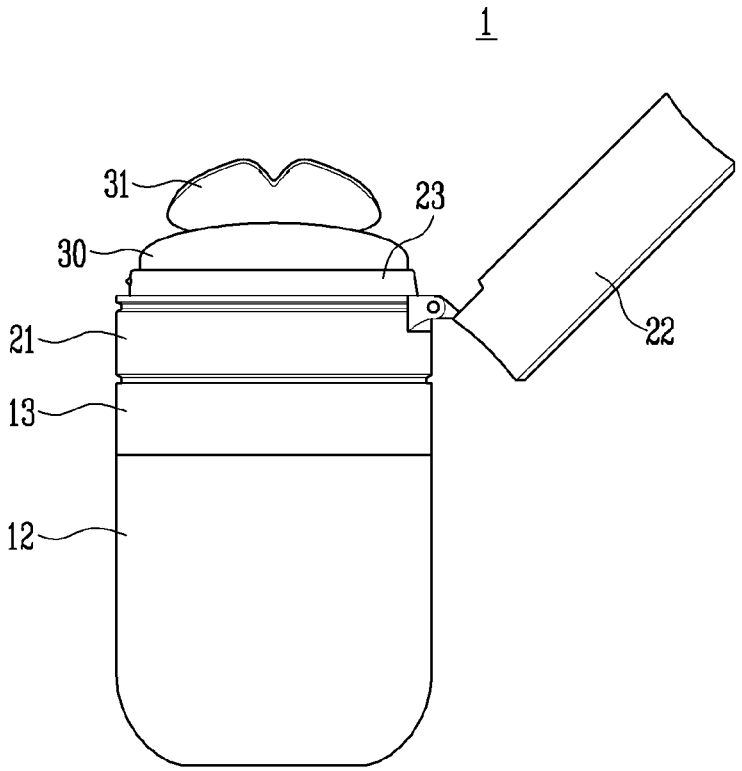
Figure 3:
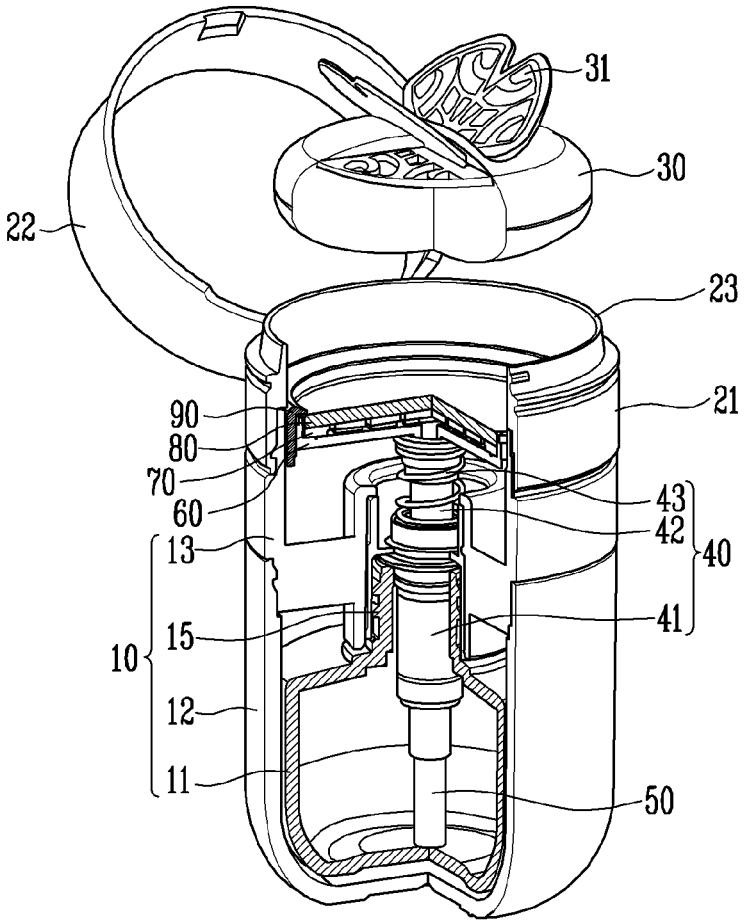
FIG. 3 is a sectional view illustrating the cosmetic vessel in accordance with the first embodiment of the present disclosure.
Figure 4:
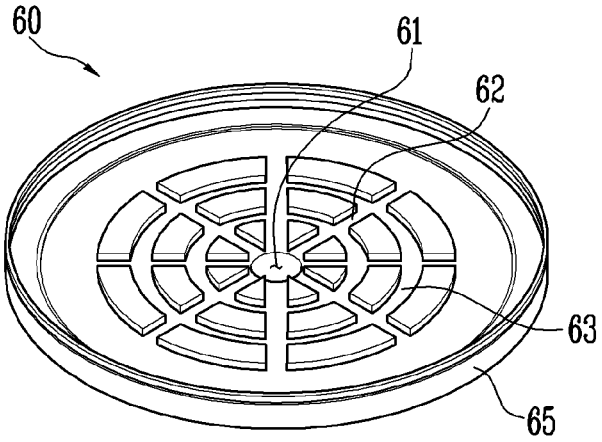
FIG. 4 is a partial enlarged view illustrating a guide part of FIG. 3.
Figure 5:
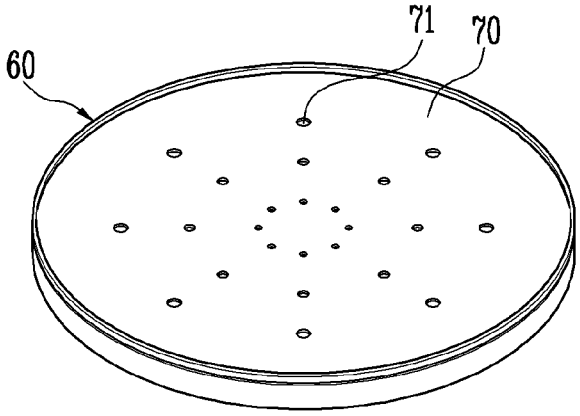
FIG. 5 is a partial enlarged view illustrating a discharge plate of FIG. 3.
Figure 6:
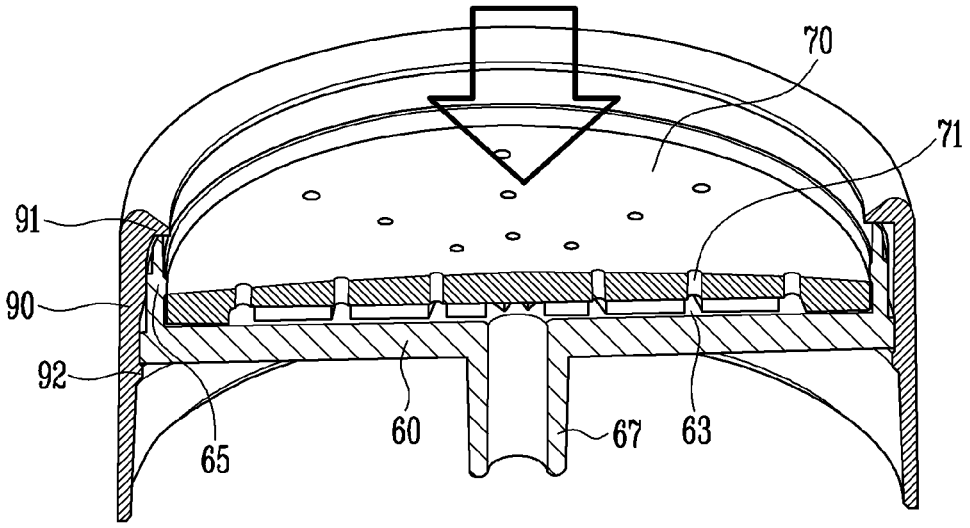
FIG. 6 is a sectional view illustrating a coupling structure of the guide part, the discharge plate, and a guide ring of the cosmetic vessel in accordance with the first embodiment of the present disclosure.

FIGS. 1 and 2 are front views illustrating a cosmetic vessel in accordance with a first embodiment of the present disclosure, FIG. 3 is a sectional view illustrating the cosmetic vessel in accordance with the first embodiment of the present disclosure, FIG. 4 is a partial enlarged view illustrating a guide part of FIG. 3, FIG. 5 is a partial enlarged view illustrating a discharge plate of FIG. 3, and FIG. 6 is a sectional view illustrating a coupling structure of the guide part, the discharge plate, and a guide ring.

Referring to FIGS. 1 to 6, a cosmetic vessel 1 in accordance with an embodiment of the present disclosure may include a vessel body 10, a cap part 20, an application member 30, a discharge means 40, a suction pipe 50, a guide part 60, a discharge plate 70, an impregnation member 80, and a guide ring 90.

The vessel body 10 may accommodate cosmetics therein, and may be openably closed by the cap part 20 which will be described later. Here, the cosmetics COS may be a low-viscosity makeup solution such as sun block. The vessel body 10 may have a cylindrical shape and be curved at a lower edge thereof. However, the present disclosure is not limited thereto.

The vessel body 10 may be composed of a plurality of parts, and these parts may be detachably configured to refill or replace cosmetics. In this embodiment, the vessel body 10 may include an inner case 11, an outer case 12, and a shoulder outer cap 13.

The inner case 11 may be in the shape of a jar which accommodates cosmetics therein, and may be received in the outer case 12 to form a double storage structure. The discharge means 40 which will be described later may be detachably coupled to an inlet 15 of the inner case 11. The outer case 12 may be configured to surround the periphery of the inner case 11, and has a space in which the inner case 11 is seated.

Since the inner case 11 and the outer case 12 may be separately manufactured, they may be made of different materials. Thus, the inner and outer cases may be made of various materials, such as PET or resin, which may reduce manufacturing cost, and may be made of elastic materials to gradually reduce volume depending on the discharge amount of contents. As such, the inner and outer cases may be made of various materials without being limited to specific materials, and may be made of the same material.

The shoulder outer cap 13 may be detachably coupled to the inlet 15 of the inner case 11 and the top of the outer case 12 while covering the upper surface of the outer case 12. Specifically, the inner surface of the shoulder outer cap 13 may be in a hollow form surrounding the inlet 15 of the inner case 11. Moreover, the lower end of the outer surface of the shoulder outer cap 13 may have a structure for coupling with the outer case 12, while the upper end of the outer surface of the shoulder outer cap 13 may have a structure for coupling with the cap part 20 which will be described later.

For instance, the shoulder outer cap 13 and the inner case 11, the shoulder outer cap 13 and the outer case 12, and the shoulder outer cap 13 and the cap part 20 may be fastened by a hook structure, or be detachably coupled by various structures, e.g. a threaded coupling structure or a force fitting structure. However, the inner case 11 and the outer case 12 may not have a separate coupling structure. In the case of replacing the inner case 11 with another one, the outer case 12 may be separated from the shoulder outer cap 13, and then the inner case 11 may be separated from the shoulder outer cap 13. The coupling process may be performed in the reverse order of the separating process.

Thereby, the inner case 11 and the shoulder outer cap 13, and the outer case 12 and the shoulder outer cap 13 may be coupled to and separated from each other. When the cosmetics are used up, additional cosmetics may be injected or the inner case 11 may be replaced with a new one.

Meanwhile, the number of parts forming the vessel body 10 is merely illustrative, and the present disclosure is not limited thereto. For example, the vessel body 10 may be composed of two or less or four or less independent parts. These parts may be coupled to each other by a threaded coupling or flange structure to maintain mechanical bond strength, or may require a sealing member (not shown) to maintain air-tightness.

The cap part 20 is coupled to open or close the top of the vessel body 10. Furthermore, the cap part 20 may define a space to accommodate the application member 30 which will be described later. Specifically, the cap part 20 may include a lower cap 21 coupled to the shoulder outer cap 13, and an upper cap 22 hinged to the lower cap 21 while covering the upper surface of the lower cap 21. Here, the lower cap 21 may include a soft capping part 23 fitted into the upper cap 22. Such a capping part 23 may be made of a material equal to or different from that of the lower cap 21. As long as the material may improve a sealing force at a surface coming into contact with the upper cap 22, the capping part may be made of a soft material such as rubber or silicone without being limited to a specific material. Thereby, it is possible to improve the air-tightness of the cap part 20, thus preventing the application member 30 or the impregnation member 80 smeared with the cosmetics from being stiffened.

The cap part 20 of this embodiment may be manufactured in any shape or structure which may accommodate the application member 30 while sealing the vessel body 10, without being limited to a specific shape or structure.

The application member 30 is accommodated in the internal space of the cap part 20, and a user may put on makeup with the application member being held on the hand by applying the cosmetics discharged from the vessel body 10 to the application member. The application member 30 may have on an upper portion thereof a handle part 31 so that it may be held by the hand. Here, the application member 30 may be a brush or a puff such as porous sponge.

In this regard, the puff may be made of a material such as synthetic resin or natural resin, may have a porous or mesh shape, and may have elasticity. Furthermore, the puff may be made of at least one material selected from a group including polyamide, polyester, polyether, polyurethane, polyethylene, polystyrene, polyolefin, polyvinyl alcohol, polyester, polypropylene, polyacryl, polyvinyl chloride, epoxy resin, sponge, nylon, cotton, nonwoven fabric, and sponge.

The discharge means 40 is detachably coupled to the inlet 15 of the inner case 11 to discharge the cosmetics to the outside. The discharge means 40 in accordance with this embodiment serves to discharge a fixed amount of cosmetic contents which are sucked up through the suction pipe 50 which will be described later. Specifically, the discharge means 40 may include a pump body 41 inserted into the inlet 15 of the inner case 11, a lift part 42 which is coupled at a first end thereof to the guide part 60 which will be described later and is coupled at a second end thereof to the pump body 41, and an elastic member 43 which is fitted over the lift part 42 to elastically support the lift part 42.

In this embodiment, as the guide part 60 which will be described later is pressed down or the user shakes the vessel body 10 up and down, a cylinder and a piston (not shown) in the pump body 41 are operated, so that the discharge means 40 may such up the contents in the vessel body 10 using the suction pipe 50 and then discharge the contents to the outside. In this case, as the lift part 42 provided under the guide part 60 is moved down by an external force, it may press the piston. Here, the elastic member 43 may be a spring, and an upper end thereof may be in close contact with the lower surface of the lift part 42 and a lower end thereof may be secured to an area of the pump body 41, thus pushing up the lift part 42.

In this embodiment, the discharge means 40 has been configured as described above. However, the present disclosure is not limited thereto, but various structures are possible as long as the discharge means may discharge the contents to the outside.

The first end of the suction pipe 50 is coupled to the discharge means 40 to communicate therewith, while the second end thereof extends to the bottom surface of the vessel body 10. In other words, the suction pipe 50 serves as a path for moving liquid cosmetics contained in the inner case 11 to the discharge means 40. In this embodiment, the suction pipe 50 may be in the shape of a vertical column, but the suction pipe 50 may have various shapes.

The guide part 60 is provided between the discharge means 40 and the discharge plate 70 which will be described later, and is configured to diffuse the cosmetics discharged from the discharge means 40. As shown in FIG. 4, the guide part 60 may have a discharge port 61 which is provided on an upper surface (surface facing the discharge plate) thereof to communicate with the discharge means 40, and first paths 62 and second paths 63 which diffuse the cosmetics supplied from the discharge port 61.

Specifically, the discharge port 61 is provided in the center of the guide part 60 to communicate with an outlet of the discharge means 40. Moreover, the guide part 60 may have the first paths 62 which diffuse cosmetics discharged from the discharge port 61, and the second paths 63 which transmit the diffused cosmetics to discharge holes 71 of the discharge plate 70 which will be described later. The second paths 63 may communicate with the first paths 62.

The first paths 62 may be radially provided around the discharge port 61. For instance, the first paths 62 may be provided in the shape radiating from the discharge port, such as a star shape or a flower shape. Here, the first paths 62 may be point symmetric with respect to the discharge port 61, and the width of the first paths through which the cosmetics pass may be kept constant or be changed (the width becomes narrower or wider) as the first paths move away from the discharge port 61. In other words, the first paths 62 may be continuous in a direction away from the outlet of the discharge means 40, and be discontinuous in a direction along an imaginary circle having as a center thereof the outlet of the discharge means 40.

The second paths 63 may be provided in a point symmetry around the discharge port 61, and be provided in a circular shape around the discharge port 61. Here, the second paths 63 may be provided in the shape of concentric circles, having the same width or different widths, through which the cosmetics pass, and the concentric circles may communicate with the first paths 62. In other words, the second paths 63 may be discontinuous in a direction away from the discharge port 61, and may connect discontinuous parts of the first paths 62.

The discharge port 61 may not be directly connected to the second paths 63 but may be directly connected to the first paths 62. When the cosmetics are discharged from the discharge means 40, the cosmetics may be diffused through the discharge port 61 to the first paths 62. Thereafter, the cosmetics may be diffused to the second paths 63 communicating with the first paths 62, and may fill the circular second paths 63. The cosmetics filled in the second paths 63 are discharged through the discharge holes 71 of the discharge plate 70 which will be described later. To this end, the second paths 63 may communicate with the plurality of discharge holes 71 provided in the discharge plate 70.

Furthermore, the guide part 60 may further include a side part 65 whose edge protrudes upwards to cover the discharge plate 70 and the impregnation member 80 which will be described later. The side part 65 may extend higher than the discharge plate 70 and the impregnation member 80 seated on the upper surface of the guide part 60 to support the components (the discharge plate and the impregnation member) seated on the upper surface from the outside. Furthermore, the side part 65 may seal a gap between the discharge plate 70 and the impregnation member 80 which will be described later.

The discharge plate 70 is seated on the upper surface of the guide part 60, and has the plurality of discharge holes 71. As shown in FIG. 5, the plurality of discharge holes 71 may be radially provided. The discharge holes 71 may correspond to the second paths 63 of the guide part 60 provided inside the discharge plate 70, and the cosmetics discharged to the discharge holes 71 are impregnated into the impregnation member 80 provided on the discharge plate 70. In this case, the discharged cosmetics may be evenly discharged to the upper surface of the discharge plate 70 by the plurality of discharge holes 71.

The discharge plate 70 may be made of metal materials such as iron preventing rust from being formed, stainless steel, copper, zinc, tin, or aluminum, and may be made of an alloy of these materials or a plated metal material. Furthermore, the discharge plate 70 may be made of a nonmetallic material such as synthetic resin or a ceramic material. However, the material of the discharge plate 70 is not limited thereto.

As such, the cosmetics discharged through the discharge holes 71 may be distributed throughout the discharge plate 70. Herein, the plurality of discharge holes 71 form concentric circles. However, the discharge holes may be formed in various shapes without being limited thereto.

The impregnation member 80 is provided on the upper surface of the discharge plate 70. The impregnation member 80 may be a porous material having cushioning effect, such as sponge. While contents discharged through the discharge hole 71 of the discharge plate 70 are impregnated into the impregnation member 80, the contents may be evenly diffused to the periphery of each discharge hole 71 as well as the entirety thereof.

When the impregnation member 80 is the sponge, the sponge is formed of at least one material selected from a group including polyamide, polyester, polyether, polyurethane, polyethylene, polystyrene, polyolefin, polyvinyl alcohol, polypropylene, polyacryl, polyvinyl chloride, epoxy resin, sponge, nylon, cotton, nonwoven fabric, etc.

In another embodiment, the impregnation member 80 may be replaced with a metal material which is not impregnated with the cosmetics. For the impregnation member 80, various materials may be selected and replaced according to a user's needs or seasons.

The guide ring 90 is coupled to the periphery of the guide part 60 in the shape of a ring to fix the guide part 60, the discharge plate 70, and the impregnation member 80 together. The inside of the guide ring 90 may be coupled to the side part 65 of the guide part 60, and the outside thereof may be in contact with the inner circumference of the vessel body 10 or the cap part 20. The guide ring 90 moves up and down along with the guide part 60 when the discharge means 40 is operated, and the outside of the guide ring 90 has no additional coupling structure. Moreover, when the cosmetics are discharged, outside air may flow into the outside of the guide ring 90.

Specifically, referring to FIG. 6, the guide ring 90 may include a step 91 whose upper end is bent inwards, and a protrusion 92 which protrudes from the inner circumference. The step 91 serves to restrict the upper end of the side part 65 of the guide part 60 with a hook structure, and the protrusion 92 serves to support the edge of the bottom of the guide part 60. The guide part 60 may be detachably coupled to the guide ring 90 by the step 91 and the protrusion 92.

The guide ring 90 may move up down along with the guide part 60 while being coupled to the guide part 60. An insert part 67 of the guide part 60 is inserted into the lift part 42 of the discharge means 40. When the lift part 42 moves up and down to perform the cosmetic discharging operation of the discharge means 40, both the guide part 60 and the guide ring 90 are also moved up and down.

In the case of replacing the discharge plate 70 or the impregnation member 80, a user separates the cap part 20 from the shoulder outer cap 13, and then presses the discharge plate 70 or the impregnation member 80 to remove the guide part 60 from the protrusion 92 of the guide ring 90, thus separating the discharge plate 70 and the impregnation member 80 seated on the guide part 60.

Thus, the cosmetic vessel 1 in accordance with the present embodiment may couple the discharge plate 70 and the guide part 60 to discharge a fixed amount of cosmetics and uniformly diffuse the cosmetics in the deep pump type vessel, thus allowing the liquid cosmetics to be widely and evenly discharged.

Furthermore, the impregnation member 80 may be provided on the discharge plate 70, thus preventing the liquid cosmetics from being splashed in all directions.

Furthermore, the guide part 60, the discharge plate 70, and the impregnation member 80 are detachably configured, so that it is easy to clean and replace the components.

Furthermore, the inner case 11 and the outer case 12 are detachably coupled to the shoulder outer cap 13, so that it is easy to refill the cosmetics and replace the inner case with another one.

Furthermore, the capping part 23 is provided to improve the air-tightness of the cap part 20, thus preventing the application member 30 or the impregnation member 80 smeared with the cosmetics from being stiffened.

Figure 7:
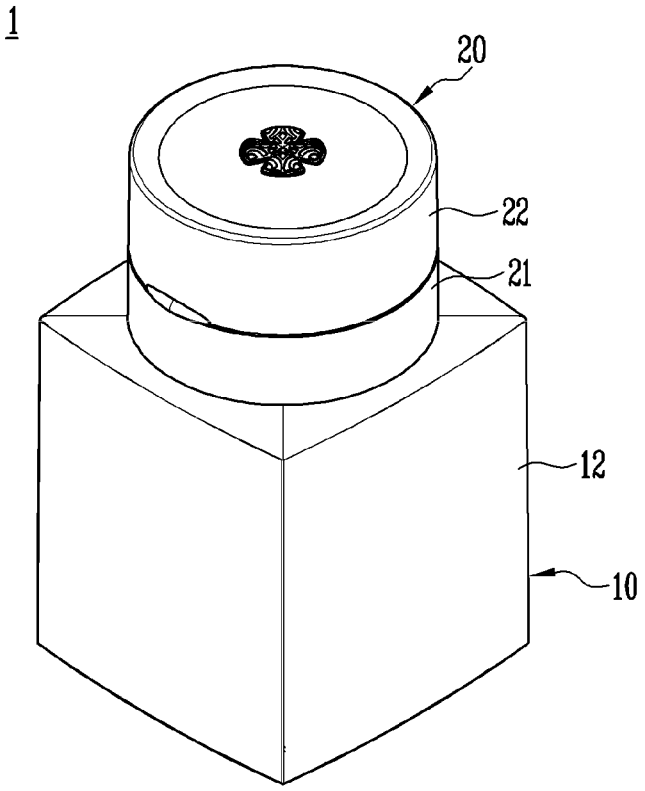
FIG. 7 is a perspective view illustrating a cosmetic vessel in accordance with a second embodiment of the present disclosure.
Figure 8:
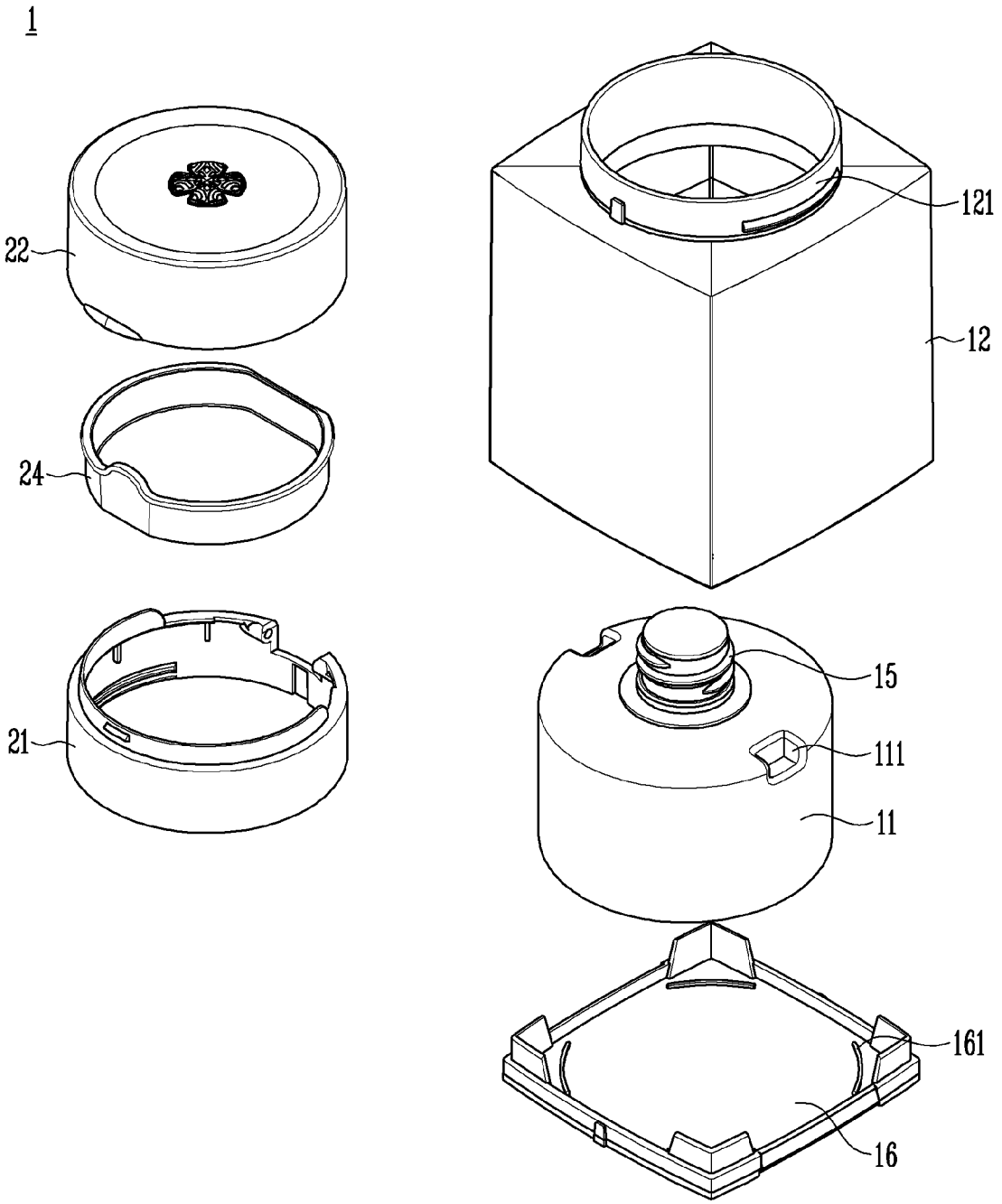
FIG. 8 is an exploded perspective view illustrating the cosmetic vessel in accordance with the second embodiment of the present disclosure.
Figure 9:
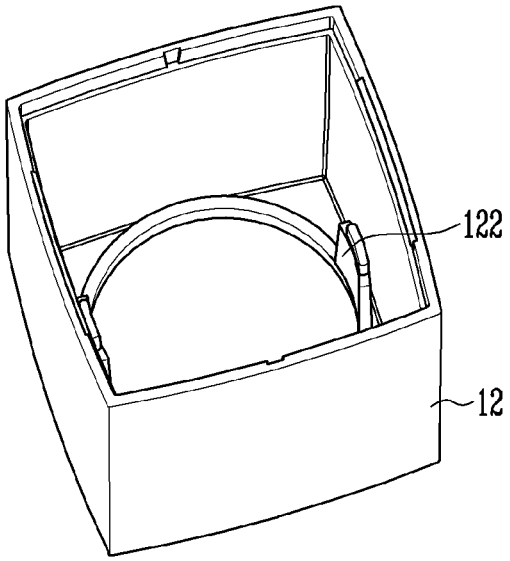
FIG. 9 is a perspective view illustrating an outer case of the cosmetic vessel in accordance with the second embodiment of the present disclosure.

FIG. 7 is a perspective view illustrating a cosmetic vessel in accordance with a second embodiment of the present disclosure, FIG. 8 is an exploded perspective view illustrating the cosmetic vessel in accordance with the second embodiment of the present disclosure, and FIG. 9 is a perspective view illustrating an outer case of the cosmetic vessel in accordance with the second embodiment of the present disclosure.

Figure 10:
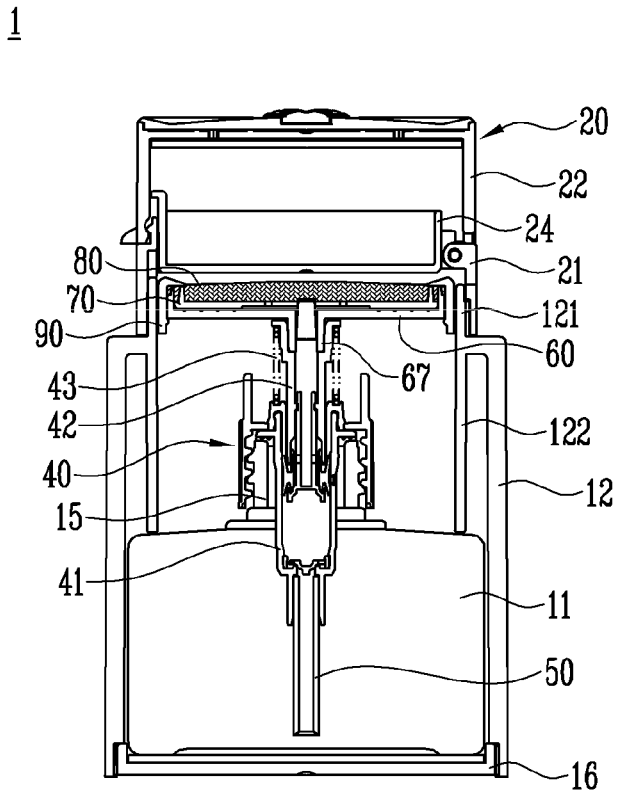
FIGS. 10 and 11 are sectional views illustrating the cosmetic vessel in accordance with the second embodiment of the present disclosure.
Figure 11:
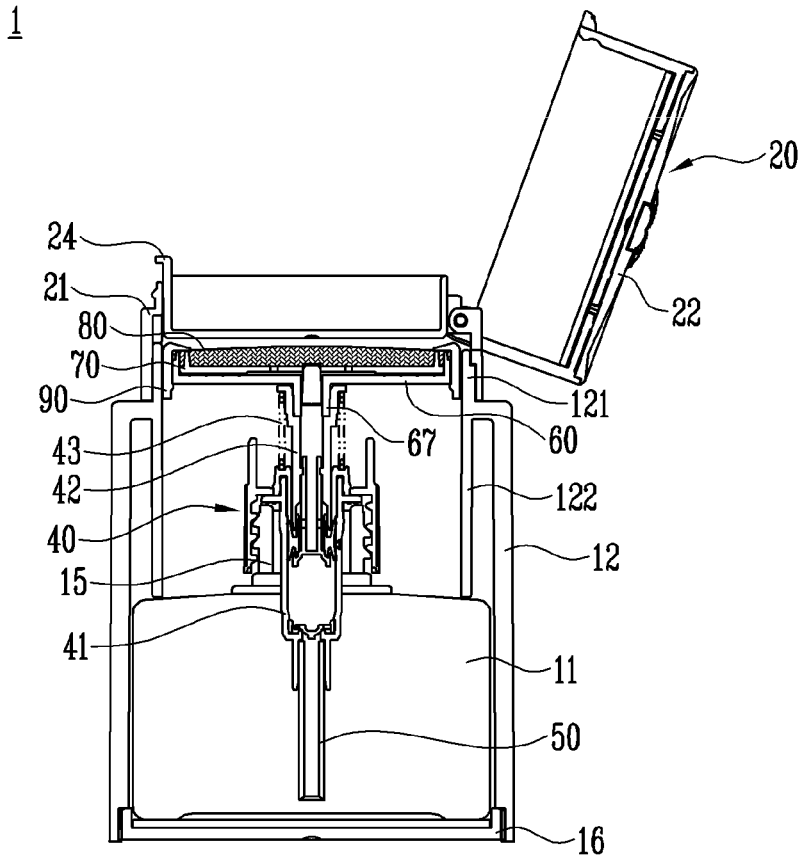
Figure 12:
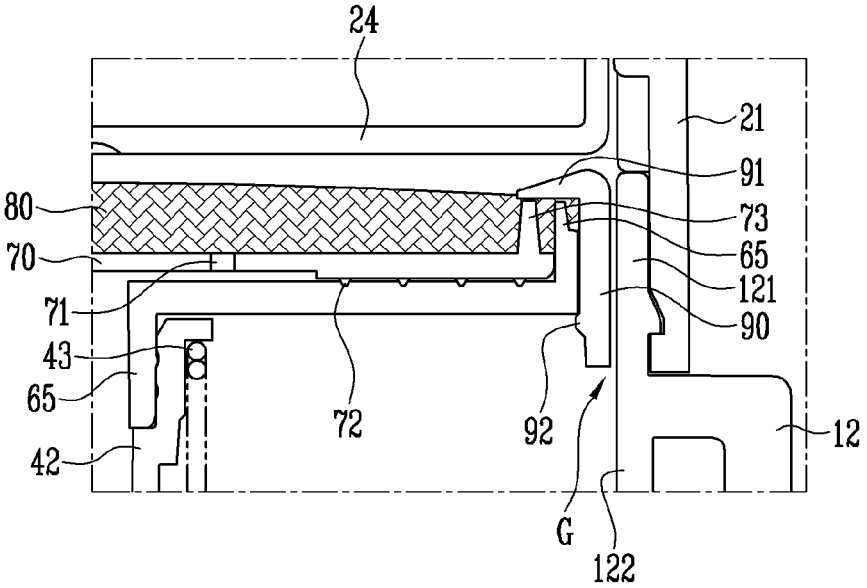
FIG. 12 is a partial sectional view illustrating the cosmetic vessel in accordance with the second embodiment of the present disclosure.

FIGS. 10 and 11 are sectional views illustrating the cosmetic vessel in accordance with the second embodiment of the present disclosure, and FIG. 12 is a partial sectional view illustrating the cosmetic vessel in accordance with the second embodiment of the present disclosure.

Hereinafter, a difference between this embodiment and the preceding embodiment will be mainly described, and contents which are not described adopt the above description.

Referring to FIGS. 7 to 12, a cosmetic vessel 1 in accordance with the second embodiment of the present disclosure may include a vessel body 10, a cap part 20, an application member 30, a discharge means 40, a suction pipe 50, a guide part 60, and a discharge part. Here, the discharge part refers to a component which transmits the cosmetics discharged from the discharge means 40 to the outside and includes a discharge plate 70, an impregnation member 80, a guide ring 90, etc.

The vessel body 10 stores the cosmetics. The vessel body 10 of this embodiment may include an inner case 11 and an outer case 12, similarly to the preceding embodiment. The inner case 11 contains the cosmetics and has an inlet 15, and the outer case 12 accommodates the inner case 11 therein.

The outer case 12 may have an opening in a top thereof, and a mouth 121 may be provided on the open top of the outer case 12, so that the cap part 20 which will be described later may be coupled to the mouth 121 to seal the outer case 12.

According to this embodiment, the outer case 12 and the inner case 11 may be provided to have different cross-sectional shapes. For instance, the inner case 11 may have a circular cross-section, while the outer case 12 may have a polygonal cross-section other than a circular cross-section.

When the inner case 11 is accommodated in the outer case 12, the outer case 12 may be fixed not to be shaken or rotated relative to the inner case 11. To this end, a restraining part 122 may be provided on the outer case 12.

As shown in FIG. 8, at least one fixing hole 111 may be provided at a predetermined point on the circumference of the inner case 11. The fixing hole 111 may be provided on an edge connecting the side surface and the upper surface. However, the present disclosure is not limited thereto, and the fixing hole may be provided at any position on an outer surface of the inner case facing the inner surface of the outer case 12.

The outer case 12 has the restraining part 122 to correspond to the fixing hole 111 of the inner case 11, and the restraining part 122 extends from the inside of the outer case 12 towards the fixing hole 111. When the inner case 11 is accommodated in the outer case 12, the restraining part may engage with the fixing hole 111. In this case, the restraining part 122 may have the same shape as a fixing end, and an end of the restraining part 122 may be force-fitted into the fixing hole 111.

When two or more fixing holes 111 are radially provided around the inlet 15 on the inner case 11 having the circular cross-section, the outer case 12 fixes the fixing holes 111 using the restraining part 122, thus restricting the rotation of the inner case 11 in the outer case 12, and preventing the inner case 11 from being shaken.

In order to stably support the inner case 11, the restraining part 122 may have a shape in which a width or thickness thereof increases from an end inserted into the fixing hole 111 towards a base end. For instance, the restraining part 122 may have the shape of an inverted trapezoid extending downwards from an upper surface inside the outer case 12.

Furthermore, in order to prevent a reduction in the support strength of the restraining part 122 due to a spacing distance between the upper surface inside the outer case 12 and the fixing hole 111 of the inner case 11, the restraining part 122 may have a shape in which a rim (unlabelled) corresponding to the cross-section of the inner case 11 extends downwards from the upper surface inside the outer case 12, and then a restraint end extends from the rim.

The outer case 12 may have a bottom cover 16 to replace the inner case 11 with a new one. To this end, the outer case 12 may be open at both a top and a bottom thereof to discharge the cosmetics, and the bottom cover 16 is detachably attached to the bottom of the outer case to open or close the interior of the outer case 12.

The bottom of the inner case 11 may be seated on the bottom cover 16, which has a projection 161 engaging with the circumference of the inner case 11. That is, the circular or arc-shaped projection 161 is provided on the upper surface of the bottom cover 16 facing the inner case 11 to engage with the circumference of the bottom of the inner case 11.

Therefore, as the inner case 11 is accommodated in the outer case 12, the restraining part 122 of the outer case 12 is coupled to the fixing hole 111 of the inner case 11, and the bottom of the inner case 11 engages with the projection 161 of the bottom cover 16, so that the inner case may be stably located in the outer case 12 without a shake or rotation.

Of course, the fixing hole 111 and the restraining part 122 may be provided in a reverse manner. In other words, the fixing hole 111 may be provided on the outer case 12 and the restraining part 122 may be provided on the inner case 11. In addition, various structures may be applied as long as it is possible to restrict the movement of the inner case 11.

At least a portion of the outer case 12 may be made of a translucent or transparent material, so that it is possible to observe the amount of the cosmetics remaining in the inner case 11 from the outside. Furthermore, it is possible to enhance an appearance by utilizing an empty space between the outer case 12 and the inner case 11.

The bottom cover 16 and the outer case 12 may be coupled to prevent the inner case 11 from being unnecessarily removed from the outer case 12. The bottom cover and the outer case may be coupled in various manners such as force-fitting or uneven coupling.

The cap part 20 is coupled to the open top of the outer case 12. The outer case 12 may have the mouth 121 to be coupled to the cap part 20, and the cap part 20 may fixedly engage with the outside of the mouth 121.

The cap part 20 may include a lower cap 21 and an upper cap 22, and the capping part 23 of the preceding embodiment may be omitted in this embodiment. The lower cap 21 of this embodiment may be directly coupled to the mouth 121 of the outer case 12, unlike the preceding embodiment in which the lower cap is coupled to the shoulder outer cap 13 of the vessel body 10.

A protrusion (unlabelled) may be provided on the outer surface of the mouth 121, and a groove (unlabelled) may be provided on the inner surface of the lower cap 21, so that the lower cap 21 may be firmly coupled to the mouth 121. Of course, the lower cap 21 and the mouth 121 may be fastened through a screw type fastening method.

The mouth 121 may be provided to surround the discharge part which will be described later. Here, a gap G is formed between the mouth 121/lower cap 21 and the discharge part, and outside air may be introduced through the gap G into the outer case 12.

The discharge means 40 of this embodiment may be a pump using the suction pipe 50, and may not be an airless pump type which isolates a storage space from the outside, but may be a deep pump type which makes the storage space to communicate with the outside and fills the storage space with the outside air in response to the discharge of the stored contents.

In the case of the deep pump type, the outside air should be introduced into the inner case 11. The inner case 11 is surrounded by the outer case 12, the top of the outer case 12 is covered by the cap part 20, and the bottom of the outer case is covered by the bottom cover 16.

According to this embodiment, the gap G may be formed around the discharge part above the outer case 12, and the outside air may be introduced through the gap G into the outer case 12. That is, as the cosmetics are discharged by operating the discharge means 40, the cosmetics in the inner case 11 are reduced and thereby internal pressure is reduced. In this case, the air may be introduced into the outer case 12 through the gap G formed between the lower cap 21/mouth 121 and the discharge part, and then be naturally sucked into the inner case 11 by the internal pressure of the inner case 11.

The air flowing through the gap G into the outer case 12 may be introduced into the inner case 11 through the inlet 15 of the inner case 11. To this end, the discharge means 40 provided on the inlet 15 of the inner case 11 may be configured to permit the inflow of the air.

The upper cap 22 covers the lower cap 21. The lower cap 21 may be provided on the mouth 121 of the outer case 12 to have the shape of a hollow part which is open at a top and a bottom thereof, and the top of the lower cap 21 may be covered by the upper cap 22 to cover the discharge part.

The upper cap 22 may be rotatably hinged to the lower cap 21, but the upper and lower caps may be provided in an independently detachable structure without a separate connection.

Furthermore, the cap part 20 of this embodiment may have an intermediate member 24 between the lower cap 21 and the upper cap 22. The intermediate member 24 may be connected through a hinge (unlabelled) connecting the upper cap 22 to the lower cap 21, or a separate detachment or open structure may be applied thereto.

The intermediate member 24 may be provided to open or close the lower cap 21, and the application member 30 such as a puff may be seated and received in the intermediate member 24. The intermediate member 24 covered by the lower cap 21 may be openably closed by the upper cap 22. Thus, the discharge part may be primarily covered by the intermediate member 24 and secondarily covered by the upper cap 22 while being enclosed by the lower cap 21.

Therefore, according to this embodiment, since the application member 30 is stored while being isolated from the discharge part, the application surface of the application member 30 is separated from the cosmetics remaining in the impregnation member 80 of the discharge part, thus improving hygiene performance.

The discharge means 40 is coupled to the inlet 15 of the inner case 11, and discharges the cosmetics to the outside through the suction pipe 50 extending to the bottom surface of the inner case 11. The discharge means 40 is a deep tube pump type using the suction pipe 50 as described above.

To this end, the discharge means 40 may include the pump body 41, the lift part 42, the elastic member 43, etc. They may adopt contents which have been described above.

The suction pipe 50 is provided such that a first end thereof communicates with the discharge means 40 and a second end thereof extends towards the bottom of the inner case 11. Thus, when the discharge means 40 is operated, the cosmetics may be transmitted through the lift part 42 to the discharge part while being sucked up along the suction pipe 50.

The internal pressure of the inner case 11 is decreased in proportion to the amount of the cosmetics discharged through the suction pipe 50. At this time, since the outside air is introduced into the inner case 11 while passing through the interior of the outer case 12 via the gap G, the inner case 11 may maintain an appropriate level of pressure.

The discharge part is moved downwards to operate the discharge means 40 and then transmit the cosmetics discharged from the discharge means 40 to the outside. The discharge part may be used as the term including the guide part 60, the discharge plate 70, the impregnation member 80, and the guide ring 90.

The guide part 60 transmits the cosmetics discharged from the discharge means 40 to the discharge hole 71 of the discharge plate 70. The guide part 60 has on a lower end thereof the insert part 67, and the insert part 67 is fitted into the lift part 42 of the discharge means 40, so that the lift part 42 is moved downwards when the guide part 60 is moved downwards, thus performing the discharge operation of the discharge means 40, as in the first embodiment.

The guide part 60 has a structure in which the cosmetics are diffused on the upper surface, and the cosmetics may be diffused using, as a diffusion space, an inner portion except for a peripheral portion where the guide part 60 and the discharge plate 70 are fixed. Here, the first path 62 or the second path 63 may be formed on the guide part 60. Alternatively, an open disc-shaped space may form the diffusion space without a path dividing structure.

Such a diffusion space may be provided to have at least a shape and a size sufficient to cover all the discharge holes 71 formed in the discharge plate 70. Furthermore, the diffusion space may have an internal structure in consideration of a distance from the outlet of the discharge means 40 to the discharge hole 71, and the size of the discharge hole 71.

The side part 65 may protrude upwards from the circumference of the guide part 60, and the guide part may engage with the guide ring 90 through the side part 65. Furthermore, the discharge plate 70 may be coupled to the circumference of the guide part 60.

The discharge plate 70 is provided on a side of the discharge means 40 through which the cosmetics are discharged, and has the discharge hole 71. The discharge plate 70 may have the shape of a plate in which one or more discharge holes 71 are arranged in a radial arrangement or the like.

The lower surface of the discharge plate 70 may be spaced apart from the upper surface of the guide part 60, and a space defined therebetween may be used as the above-described diffusion space. As the circumference of the discharge plate 70 is in close contact with the circumference of the guide part 60, it is possible to prevent the cosmetics diffused in the diffusion space to leaking out.

To this end, a separate sealing member (not shown) may be provided between the circumference of the discharge plate 70 and the circumference of the guide part 60, and the sealing member may seal the outside of the diffusion space through vertical bonding.

Furthermore, while a step is formed on the discharge plate 70 such that the circumference of the discharge plate protrudes downwards from the lower surface thereof, the circumference of the lower surface may be in contact with the upper surface of the guide part 60 to make a sealing state. In this case, the center of the lower surface of the discharge plate 70 and the center of the upper surface of the guide part 60 are spaced apart from each other, thus forming the diffusion space.

The discharge plate 70 may engage with the guide part 60 through a uneven part 72 around the outside of the discharge hole 71. A protruding structure is applied to the discharge plate 70 and a recessed structure is applied to the guide part 60 to correspond to the protruding structure, so that the discharge plate 70 and the guide part 60 may be firmly fitted and coupled to each other. In the case of using the uneven part 72, an angle of the discharge plate 70 seated on the guide part 60 may be limited.

Similarly to the guide part 60, the discharge plate 70 may be provided such that the circumference thereof protrudes upwards. The side part 65 of the guide part 60 may protrude upwards, and the discharge plate 70 may have a circumferential part 73 which protrudes upwards.

Here, the upper end of the circumferential part 73 of the discharge plate 70 and the upper end of the side part 65 of the guide part 60 may be provided to have the same height, so that they may be in contact with each other by the guide ring 90. That is, the guide ring 90 which will be described later is in contact with the circumferential part 73 of the discharge plate 70 while engaging with the bottom of the guide part 60 and the side part 65 of the guide part 60, thus limiting the upward movement of the discharge plate and causing the discharge plate 70 to be fixedly pressed against the guide part 60.

Of course, the discharge plate 70 of this embodiment may be configured such that the circumferential part 73 does not protrude upwards but at least the height of the circumferential part corresponds to the side part 65 of the guide part 60, thus fixing the circumference of the discharge plate 70 by the guide ring 90. In other words, herein, it may be construed that the circumferential part 73 embraces the circumferential part of the discharge plate 70 having a height corresponding to that of the side part 65 of the guide part 60.

In this case, the discharge plate 70 may have the shape of a dome which is convex at the upper surface thereof, and be reduced in height in a direction from the center to the periphery, so that the height of the circumference thereof may correspond to that of the side part 65 of the guide part 60.

The impregnation member 80 is provided on the upper surface of the discharge plate 70, and is impregnated with the cosmetics discharged through the discharge hole 71 of the discharge plate 70. If the user presses the impregnation member 80 using the application member 30, the discharge part including the impregnation member 80 moves downwards to operate the discharge means 40 and thereby discharge the cosmetics. The discharged cosmetics leak to the impregnation member 80.

At this time, the user may apply the cosmetics delivered to the application surface of the application member 30 through the impregnation member 80 to the skin or the like. That is, the impregnation member 80 may temporarily store the cosmetics, and may realize cushion effect when the user uses the cosmetics. To this end, the impregnation member 80 may have a dome-shaped cross-section.

Of course, the impregnation member 80 may be omitted. In this case, if the upper cap 22 opens, the discharge plate 70 may be exposed to the outside in place of the impregnation member 80. In the case of applying a structure in which the discharge plate 70 is directly exposed to the outside, the discharge plate 70 may be made of at least partially metal or be coated with metal, thus improving an appearance.

A separate filter (not shown) may be provided between the discharge plate 70 and the impregnation member 80. The filter may be made of various materials such as cotton, mesh, or synthetic resin, and be also made of a porous material similar to the impregnation member 80. The filter may have elastic force, and the periphery thereof may be fixedly pressed by the guide ring 90 to allow the filter and the discharge plate 70 to be in sufficiently close contact with each other.

Such a filter may have a micro hole which is smaller than at least the discharge hole 71. In particular, the micro hole of the filter may be formed smaller than the pore of the impregnation member 80 to filter impurities.

The guide ring 90 is coupled to the circumference of the guide part 60. The guide ring 90 may fix the guide part 60 and the impregnation member 80, and the discharge plate 70 may be secured to the guide part 60.

The guide ring 90 may fix the guide part while vertically engaging with the circumference of the guide part 60. Specifically, the guide ring 90 may include the step 91 whose upper end is bent inwards, and the protrusion 92 which protrudes from the lower end of the inner circumference.

The protrusion 92 of the guide ring 90 is caught by the lower end of the guide part 60. The protrusion 92 may be provided in the shape of an annular rim to be caught while surrounding the lower end of the guide part 60, or two or more protrusions may be radially arranged.

The protrusion 92 of the guide ring 90 is caught by the lower end of the guide part 60 to restrict an upward movement of the guide ring. Here, the step 91 of the guide ring 90 may engage with the side part 65 of the guide part 60. Therefore, the vertical movement of the guide ring 90 is restricted by the guide part 60.

The step 91 of the guide ring 90 compresses the periphery of the impregnation member 80, thus keeping the impregnation member 80 in the guide part 60.

Furthermore, the step 91 of the guide ring 90 comes into contact with the circumferential part 73 protruding upwards from the circumference of the discharge plate 70 to prevent the circumferential part 73 of the discharge plate 70 from moving upwards. Thereby, the top and bottom of the discharge plate 70 may be fixedly brought in close contact with the guide part 60.

The step 91 of the guide ring 90 may be provided to fixedly compress at least the impregnation member 80 and the circumferential part 73 of the discharge plate 70, among the impregnation member 80, the side part 65 of the guide part 60, and the circumferential part 73 of the discharge plate 70.

For example, the step 91 may have an "L"-shaped cross-section, and may be configured to press the circumferential part 73 of the discharge plate 70 with the lower end extending downwards without pressing the side part 65 of the guide part 60. The reason is because the upward movement of the guide part 60 is indirectly restricted, if the step 91 fixedly catches the discharge plate 70 seated on the guide part 60.

Further, in this case, the side part 65 of the guide part 60 may be slightly higher than the circumferential part 73 of the discharge plate 70, and the upper end of the side part 65 may be accommodated in the step 91, thus further reinforcing a sealing function.

Through the structure of the guide ring 90, the discharge plate 70 and the impregnation member 80 may be fastened to stably maintain their positions without vertically lifting with respect to the guide part 60.

As described above, according to this embodiment, the cosmetics are stored using the inner case 11 having a circular cross-section, the inner case 11 is accommodated in the outer case 12 having a non-circular cross-section, and the position of the inner case 11 in the outer case 12 is firmly maintained using the restraining part 122, so that it is possible to freely select an external shape regardless of the shape of the inner case 11.

Furthermore, according to this embodiment, in the cap part 20 which uses the deep pump type discharge means 40, surrounds the guide ring 90, and opens or closes the discharge part, when the cosmetics are discharged by the operation of the discharge means 40, the outside air passes between the guide ring 90 and the cap part 20/the mouth 121 to be transmitted to the inner case 11, thus compensating for the internal pressure of the inner case 11.

A cosmetic vessel according to the present disclosure may be configured such that a discharge plate and a guide part are coupled to a deep pump type vessel to discharge a fixed amount of cosmetics and uniformly diffuse the cosmetics, thus allowing liquid cosmetics to be widely and evenly discharged.

The present disclosure is not limited to the above-described embodiment, and a combination of at least two or more of the above embodiments or a combination of at least one of the above embodiments and a known technology are possible.

Although the present disclosure has been described with reference to specific embodiments, it is apparent to those skilled in the art that the present disclosure may be changed and modified in various ways without departing from the scope of the present disclosure, which is described in the following claims.

All simple modifications or changes of the present disclosure fall within the purview of the present disclosure, and the specific scope of the present disclosure will be apparent from the following claims.

What is claimed is:

1. A cosmetic vessel, comprising:

a vessel body including an inner case configured to accommodate cosmetics and having an inlet, and an outer case configured to accommodate the inner case therein and having an opening in a top thereof;

a cap part coupled to the open top of the outer case;

discharge means coupled to the inlet, and configured to discharge the cosmetics to an outside through a suction pipe extending to a bottom surface of the inner case; and a discharge part moving downwards to operate the discharge means, and configured to transmit the cosmetics discharged from the discharge means to the outside, wherein the discharge part comprises a discharge plate provided on a side of the discharge means through which the cosmetics are discharged and having a discharge hole, a guide part configured to transmit the cosmetics discharged from the discharge means to the discharge hole, and a guide ring coupled to a circumference of the guide part, wherein the cap part is provided to enclose the guide ring and to open or close the discharge part, and is configured such that outside air passes between the guide ring and the cap part to be transmitted to the inner case when the cosmetics are discharged by an operation of the discharge means, and wherein the outer case has a cross-sectional shape different from that of the inner case, and comprises a restraining part which engages with the inner case to restrain a position of the inner case.

2. The cosmetic vessel of claim 1, wherein the inner case has a circular cross-section, and the outer case has a non-circular cross-section.

3. The cosmetic vessel of claim 2, wherein a fixing hole is provided at a predetermined point on a circumference of the inner case, and wherein the restraining part comprises a fixing end which extends from an inside of the outer case towards the fixing hole, and engages with the fixing hole when the inner case is accommodated in the outer case, thus restricting rotation of the inner case in the outer case.

4. The cosmetic vessel of claim 2, wherein the outer case comprises a bottom cover which is detachably attached to a bottom thereof and on which the inner case is seated, and wherein the bottom cover has a projection engaging with the circumference of the inner case.

5. The cosmetic vessel of claim 1, wherein the discharge part further comprises an impregnation member provided on an upper surface of the discharge plate, and wherein the guide ring fixes the guide part and the impregnation member.

6. The cosmetic vessel of claim 5, wherein the guide part is configured such that the circumference thereof protrudes upwards, and wherein the guide ring comprises a step which is bent inwards at an upper end thereof and engages with a circumference of the impregnation member, and a protrusion which protrudes from an inner circumference thereof to be caught by a lower end of the guide part.

7. The cosmetic vessel of claim 1, wherein the guide part is configured such that the circumference thereof protrudes upwards, wherein a height of a circumferential part of the discharge plate corresponds to that of the upwardly protruding circumference of the guide part, and wherein the guide ring comprises a step which is bent inwards at an upper end thereof and engages with a circumference of the discharge plate, and a protrusion which protrudes from an inner circumference thereof to be caught by a lower end of the guide part.

8. The cosmetic vessel of claim 1, wherein the discharge plate engages with the guide part through an uneven structure around an outside of the discharge hole.

* * * * *